United States Patent [19]

Frey, Jr.

[11] 4,109,230

[45] Aug. 22, 1978

[54] COMPACT ELECTRICAL CONTROL

[75] Inventor: Sydney W. Frey, Jr., Brookfield, Wis.

[73] Assignee: Allen-Bradley Company, Milwaukee, Wis.

[21] Appl. No.: 768,998

[22] Filed: Feb. 16, 1977

[51] Int. Cl.[2] ..... H01C 10/32

[52] U.S. Cl. ..... 338/164; 338/123; 338/128; 338/130; 338/162; 338/184; 338/199

[58] Field of Search ..... 338/162, 164, 184, 199, 338/160, 118, 123, 128, 130, 125, 131, 132, 134, 137; 200/302

[56] References Cited

U.S. PATENT DOCUMENTS

| | | | |
|---|---|---|---|
| 2,922,973 | 1/1960 | Vacha | 338/184 X |
| 3,200,208 | 8/1965 | Mastney | 200/302 X |
| 3,227,822 | 1/1966 | Corey | 200/302 X |
| 4,031,348 | 6/1977 | Eberhardt | 200/302 X |

*Primary Examiner*—C. L. Albritton
*Attorney, Agent, or Firm*—Quarles & Brady

[57] ABSTRACT

A compact electrical control, such as a potentiometer, a rheostat, or a switch includes a housing and a shaft rotatably mounted within the housing. The housing has a cavity for receiving a resilient annular seal surrounding the shaft, and the shaft is provided with a radial pressure plate that bears against the seal. A rotary assembly composed of resistance or switch elements is mounted on the shaft between the pressure plate and a journaled end of the shaft, and the resistance or switch elements are contacted by stationary contacts held in the housing. The seal is axially compressed between the pressure plate on the shaft and a cavity end wall, and is radially compressed between a circumferential side wall and the shaft, so that the seal both prevents liquid from entering the housing along the shaft and controls axial end play of the shaft.

3 Claims, 8 Drawing Figures

Fig. 1
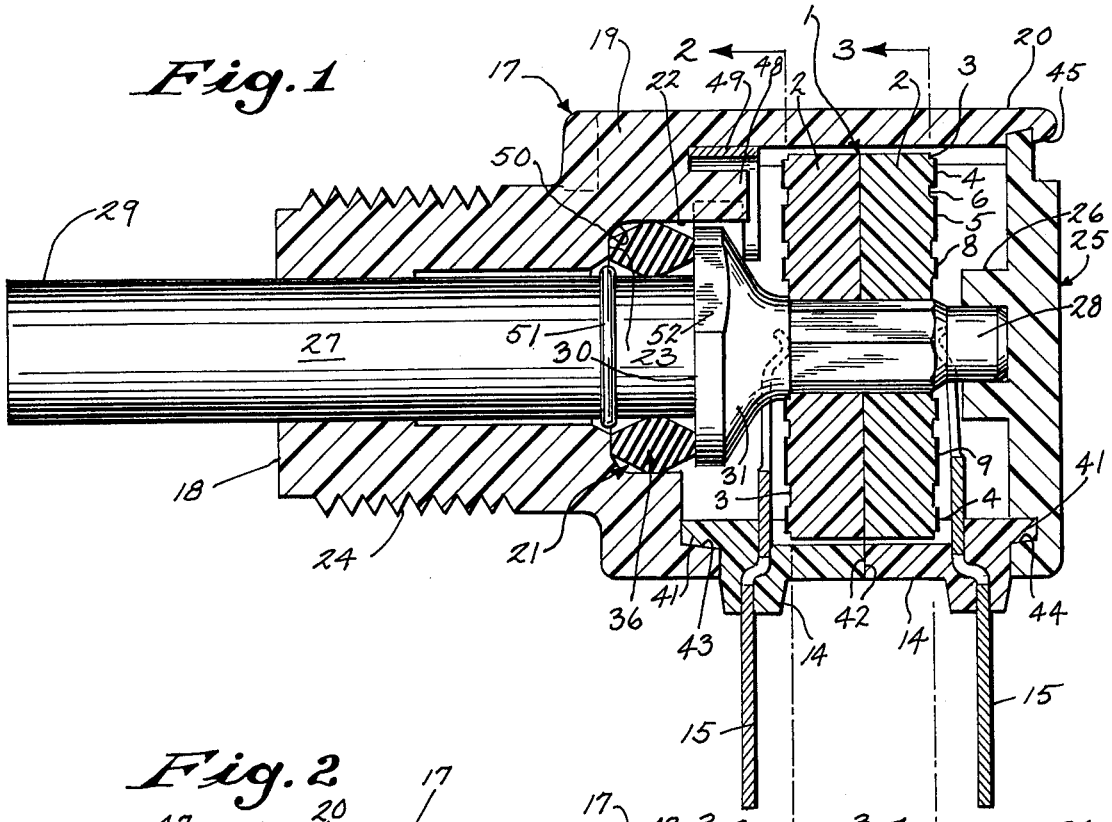
Fig. 2
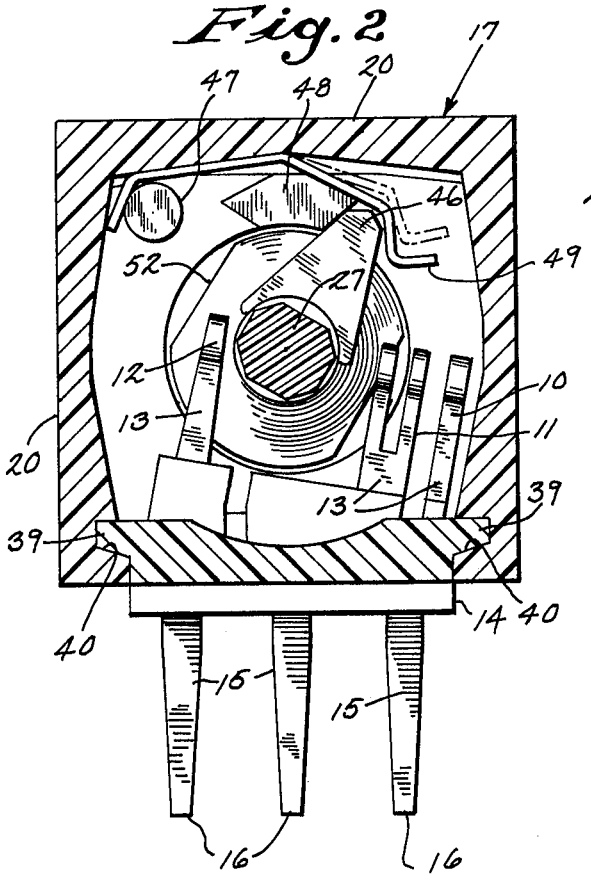
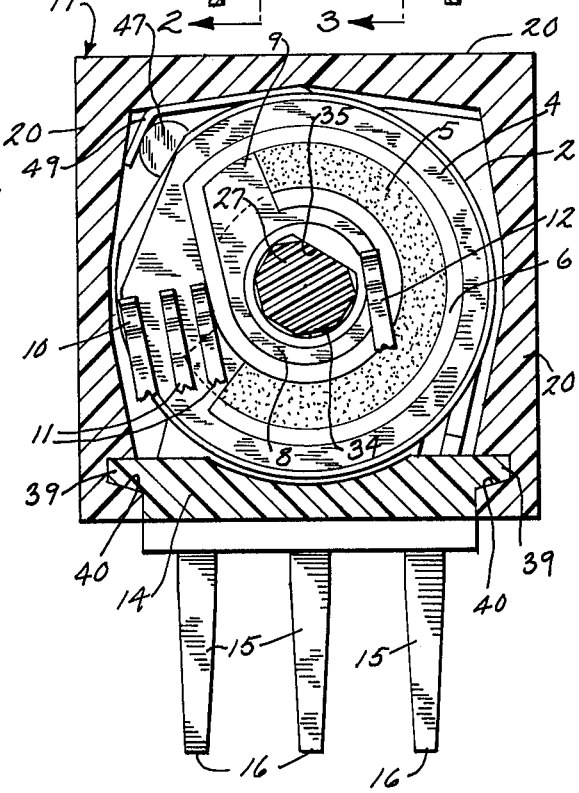
Fig. 3

Fig.4
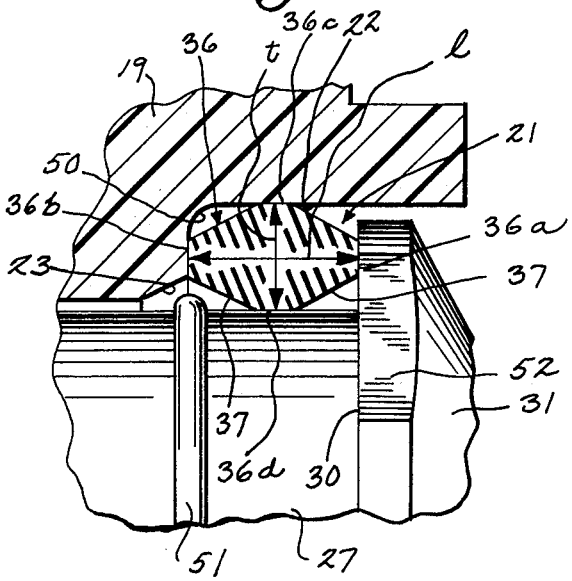
Fig.5
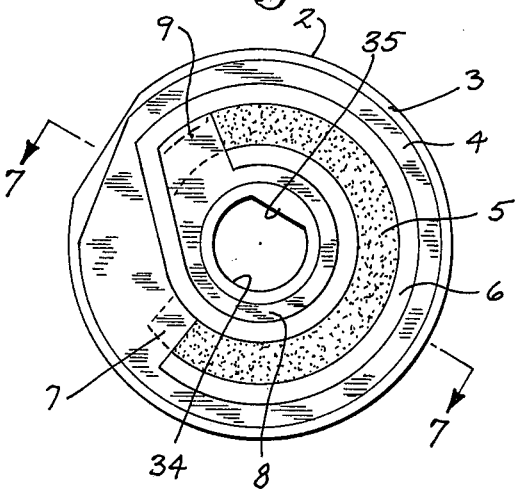
Fig.6
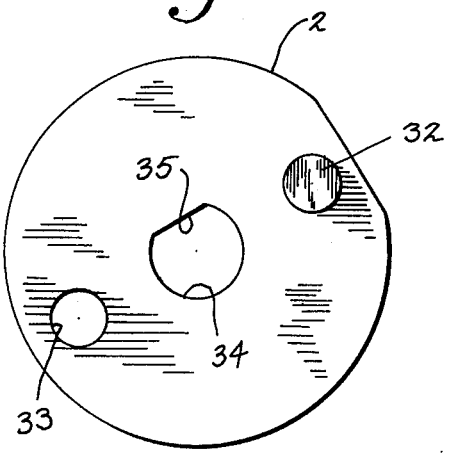
Fig.7
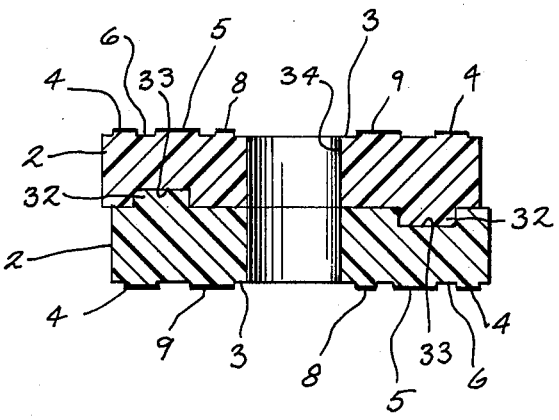
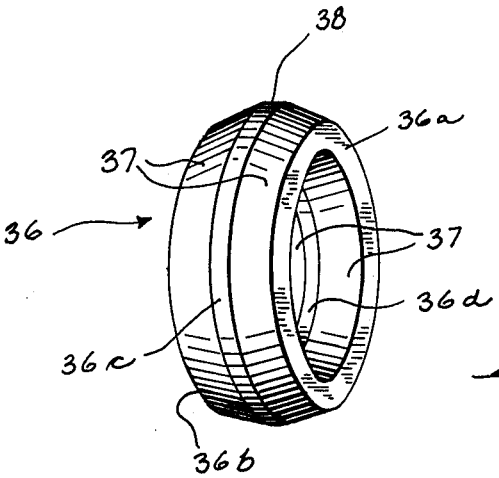
Fig.8

COMPACT ELECTRICAL CONTROL

BACKGROUND OF THE INVENTION

The field of this invention is compact electrical controls, and in particular a miniaturized form of a switch or a variable resistor.

There are several types of variable resistors. A rheostat is one which has a first terminal connected to one end of a resistance path and a second terminal connected to a contact that slides along the length of the resistance path to vary the resistance value. Another type is a potentiometer which has a separate terminal connected to each end of a resistance path, and a third terminal connected to a sliding contact that moves along the resistance path. The potentiometer acts as a voltage divider, to divide a voltage applied across the resistance path according to the position of the contact that moves along the resistance path. The present invention can be utilized in either of these forms or as a switching device where a rotating disc makes and breaks connections with the terminals.

The trend towards miniaturization of electrical apparatus has made it necessary to develop dependable electrical controls which are much smaller than previously required. A need has also developed for less expensive minature controls. Heretofore, it has been difficult to make an inexpensive, compact electrical control which is not only moisture proof, but also which is accurate and will retain selected settings.

SUMMARY OF THE INVENTION

The present invention resides in a minature electrical control having a resilient sealing member interposed between axially facing surfaces of the stationary and rotary parts of the control, so as to apply an axial bias force to the parts, in which the sealing member has a pronounced axial length with respect to its radial thickness.

One preferred form of the control includes a housing with side walls extending rearward of a base portion to define a hollow interior. There is an annular seal cavity in the base portion with a circumferential side wall and an axial end wall which opens upon the hollow interior. A shaft for the housing extends through the seal cavity, and has a radial extending pressure face which faces the seal cavity to define the axial extent of the cavity. A rotary assembly composed of resistance or switch elements is mounted on the shaft within the housing behind the pressure face, and terminal members extend into the housing to make connection with stationary contacts that engage the resistance assembly. An annular resilient seal is deposited in the seal cavity that takes up, or absorbs, end play and makes a firm assembly between parts.

The seal is advantageous in several respects, in addition to its usual function of providing a liquid proof construction. First, it is interposed between stationary and rotatable parts of the device to form an axially compressible member that absorbs axial spacing between the parts. Further, it is proportioned with an unusual axial length that can provide for substantial axial compression without undue stress, or filling up of the cavity in which it resides. This means that dimensional tolerances of the parts of the device can be accommodated, while simultaneously holding the rotary positions of the assembly in place without axial end play.

A second feature of the resilient seal is that it has a tapered configuration which leaves substantial voids in the corner regions of the cavity in which it resides. These void regions can be utilized for strengthening fillets in the mating cavity and the reception of features that enhance the miniaturization of the device.

It is an object of the invention to provide an electrical control that is small and compact.

It is another object of the invention to provide a compact electrical control which has a moisture proof housing comprised of a minimum number of components which can be readily and inexpensively assembled.

It is a still further object to provide a compact electrical control which includes a resilient seal which not only prevents moisture from entering the housing, but also possesses a maximum ability to absorb axial assembly tolerances thus minimizing "end play" of the control shaft.

These and other objects and advantages of the invention will appear in the description to follow. In the description reference is made to the accompanying drawings which form a part hereof, in which there is shown by way of illustration and not of limitation a specific form in which this invention may be embodied.

BRIEF DESCRIPTION OF THE DRAWINGS

FIG. 1 is a side view in elevation and in section of a variable resistance control embodying the invention;

FIG. 2 is a view in section of the control taken in the plane 2—2 indicated in FIG. 1;

FIG. 3 is a view in section of the control taken in the plane 3—3 indicated in FIG. 1;

FIG. 4 is an enlarged view partly in section of a portion of the control of FIG. 1 showing a novel seal in cross-section;

FIG. 5 is a view of the front face of one rotary resistance unit employed in the control;

FIG. 6 is a rear view of the rotary resistance unit of FIG. 5;

FIG. 7 is a view in section showing two rotary resistance units assembled together; and FIG. 8 is a perspective view of the novel seal employed in the invention.

DESCRIPTION OF THE PREFERRED EMBODIMENT

Referring now to the drawings, the control, as shown, is a variable resistance control which has a rotary assembly 1 made up of a pair of similar, individual resistance units 2. The body of each unit 2 is of molded insulating material with a circular front face 3, as best seen in FIG. 5. Formed on a slightly raised, conforming ridge on the front face 3 is an outer end terminal collector track 4. The collector track 4 comprises a ring of low resistance material such as closely packed conductive particles of metal in a suitable binder. Substantially concentric with the outer end terminal collector track 4 is a circular resistance track 5 in the form of a nearly complete circle that is also formed on a slightly raised conforming ridge. The resistance track 5 comprises a shallow layer of relatively high resistive material, preferably in the form of distributed carbon black particles in a binder. The resistance track 5 and the collector track 4 are separated by a concentric dielectric gap 6 except at one end 7 of the resistance track 5 where it is electrically connected to and overlaid by the collector track 4.

Substantially concentric with the resistance track 5 is an inner end terminal collector track 8. The collector track 8 covers a conforming ridge near the center of the front face 3, and like the outer terminal collector track 4 is comprised of very low resistance conductive particles. The inner collector track 8 is separated from the resistance track 5, except at the end 9 of the resistance track 5 where the two tracks are electrically connected by one overlaying the other.

In a preferred embodiment, each rotary resistance unit 2 is formed by first preparing a decal by silk screening inks for the track patterns 4, 5 and 8 upon a flexible sheet of suitable plastic, such as Mylar. Once the decal is prepared it is placed in a mold and the insulating body of the unit 2 is pressure molded directly upon the decal, so that the track patterns are transferred from the decal and become a part of the front face of the unit 2. The insulating material for the unit body is a suitable resin which is readily adapted for molding and also exhibits excellent insulating properties. The plastic sheet is then stripped from the molded piece, leaving the track patterns on the piece as a part thereof. Obviously, if desired, the resistance and collector tracks can be applied by other suitable methods to the front face of the unit 2. The two resistance units 2 are assembled into the assembly 1 by placing them back to back. As shown in FIGS. 6 and 7, integrally molded pins and sockets 32, 33 on the back faces of the units 2 mate with one another and orient the resistance tracks 4, 5 and 8 on the front faces, so that they will be in proper correlation for engagement by stationary contacts.

The tracks 4, 5 and 8 are each contacted by a separate stationary contact, and there is a set of three contacts for each resistance unit 2. As seen in FIGS. 2 and 3, a set of contacts includes an end contact 10 that bears on the outer collector track 4, a bifurcated resistance track contact 11, and a second contact 12 that bears on the inner collector track 8. Each of the contacts 10, 11 and 12 is in the form of a thin spring finger 13 jutting from its individual terminal strip 15 that is an insert in a molded terminal block 14 of insulating material. The outer end of each terminal strip 15 forms a terminal pin 16. As seen in FIG. 1, the tips of the contacts are preferably radiused so that they will slidably engage their respective tracks as the resistance assembly 1 is rotated.

As seen in FIG. 1 of the drawings, the rotary resistance assembly 1 and the two sets of electrical contacts 10, 11, 12 are arranged in operable position within a molded housing 17 of insulating material. The housing 17 has a mounting bushing 18 at its front, or the left as viewed in FIG. 1. This bushing 18 extends from a base portion 19, and a set of side walls 20 extend rearward from the base 19 to define a hollow interior. The base portion 19 includes an annular seal-receiving cavity 21 with a circumferential wall 22 and an axial end wall 23 which lies in a radial plane. This seal-receiving cavity 21 opens upon the hollow interior of the housing 17. The housing 17 also includes a rear cover 25 which forms an end wall seated upon the rear edges of the side walls 20. It is seen in FIG. 1 that the cover 25 is staked in place. The cover 25 is provided with an internal bearing 26 which opens to the housing interior and is in axial alignment with the bushing 18.

Still referring to FIG. 1, an operating shaft 27 is received in the bushing 18 and extends through the seal cavity 21 into the hollow interior of the housing 17. The rear end 28 of the shaft 27 is journaled in the bearing 26, and the other shaft end 29 extends beyond the bushing 18 so that the shaft 27 can be conveniently rotated for adjusting the resistance assembly. The bushing 18 is preferably provided with an external thread 24, so it can be utilized with a lock nut (not shown) to attach the device to a control panel or the like.

As seen in FIGS. 1 and 4, the shaft 27 has a forward facing, integral, radially extending pressure face 30 which faces toward the seal cavity 21 and defines its axial extent. This pressure face 30 is part of a generally conical shaped flange 31, and the rotary resistance assembly 1 made up of the pair of resistance units 2 is mounted on the shaft 27 between the flange 31 and the journaled shaft end 28. In FIGS. 6 and 7, it can be seen that each resistance unit 2 is provided with a central opening 34 which has a flat 35. The flat 35 is used to key each resistance unit 2 to the shaft 27, so that there is proper alignment and to have the parts rotate together.

Turning now to FIGS. 1 and 4, it can be seen that an annular, resilient seal 36 is deposited in the seal cavity 21. This seal 36 is axially compressed between the cavity end wall 23 and the pressure face 30 of the shaft 27. It is also radially compressed between the surface of the shaft 27 and the circumferential side wall 22 of the cavity 21. As seen best in FIG. 4, the seal 36 has a cross-sectional shape in an axial plane resembling a diamond with the points, or apexes, flattened, or truncated. The axial length "*l*" of the diamond shape exceeds its radial thickness "*t*." When axially compressed between the pressure face 30 and the wall 23, the seal 36 contacts and forms liquid tight seals at the four truncated faces **36*a*, 36*b*, 36*c* and 36*d* with the pressure flange 30, the end wall 23, the circumferential wall 22, and the shaft 27, respectively. The seals thus formed effectively prevent liquid passing between the interior surface of the bushing 18 and the exterior surface of the shaft 27 from entering the hollow interior of the housing 17**.

The seal 36 is shown in its uncompressed form in FIG. 8. The unique shape of the seal 36 provides advantages both in molding the seal 36 and the assembly and operation of the device. The diamond-like cross-sectional shape of the seal 36 provides an ideal rubber molding geometry as it permits a tolerance for the mold parting line, and easily ejects from a mold cavity. As seen in FIG. 4, the slanting sides of the diamond configuration leave substantial voids in the corner regions of the cavity 21. This gives advantages for miniaturizing the device. First, fillet 50 can be added to the corner of the cavity 21 to strengthen the housing 17 by eliminating a sharp corner that would create high localized stress. Second, the mold undercut ridge 51 on the shaft 27, which is necessary for effective molding of the synthetic shaft, can be conveniently positioned to intrude partially into the cavity 21. And, thirdly, the beveled surfaces of the seal 36 that taper in axially cause the diameter of the seal face **36*a* to be reduced, so that a flat 52 on the circumferential edge of the shaft flange 31 can be accommodated. The flat 52 is the point at which the molding gate for the shaft 27 is located, and to alleviate the possibility of unwanted radial protrusion of "flash" the flat 52 provides a receded surface that can be rough with protrusions which could abrade the seal 36 in the absence of the taper that reduces the face 36*a***.

In addition, the shape of the seal 36 provides advantages in the assembly of the device. The chamfered or bevel surfaces 37, of the seal 36 that are at angle to the shaft axis (see FIG. 8) serve as lead-ins and the more rigid, thicker midsection 38 is sufficiently stiff for rugged handling, even though the seal 36 may be miniature in size. The seal 36 also provides an important advantage in operation of the device in that it controls shaft "end play" and minimizes torque variations. The high axial compressibility of the seal, due to the dimension "*l*" exceeding the dimension "*t*," effectively absorbs the axial assembly tolerances which result when inexpensive, miniature, high tolerance molded parts are used for constructing the device.

Returning to FIGS. 1, 2 and 3, it can be seen that the bottom wall of the housing 17 is formed by the two terminal blocks 14 holding the two sets of stationary contacts. As seen in FIGS. 2 and 3, laterally extending tongues 39 of the terminal blocks 14 enter grooves 40 in the side walls 20 of the base 19 to form secure tongue and groove relationships. As seen in FIG. 1, the terminal blocks 14 are also provided with a crosswise tongue 41 and a flat back 42.

Turning now to FIG. 1, it is seen that when two of the terminal blocks 14 are utilized, they are arranged in a back-to-back relationship to form a unitary member which completes the bottom wall of the housing 17. When thus assembled, the tongue 41 of one terminal block 14 rests upon a seating ledge 43 in the base portion 19 of the housing, and the tongue 41 of the other terminal block 14 is in a groove 44 in the rear cover 25. To form a moisture proof housing the cover 25 is hot staked to the base 19, as at 45, and the various interfaces, as between the two flat backs of the terminal blocks 14, are sealed with a suitable material such as an epoxy resin.

Although the switch option of the invention can be employed without on-off indicators, in the preferred embodiment shown in the drawings an inexpensive on-off indicator is provided. As seen best in FIG. 2, the shaft 27 is provided with a radially extending detent finger 46 and the base 19 of the housing 18 is provided on its inner end wall with a positioning pin 47 and a stop block 48. The stop block 48 not only limits the extent to which the shaft 27 can be rotated, but also cooperates with the pin 47 to retain a detent spring 49 in proper position. The detent finger 46 and the stop block 48 provide an inexpensive means of positively indicating the on-off positions. The detent mechanism shown securely retains the control in the "off" position thereby preventing it from being accidentally turned on.

Although for purposes of illustration an embodiment of a potentiometer has been shown and described in which two rotary resistance units have been employed, it is to be understood that the invention is not so limited. If desired, one of the resistance units can be replaced with a unit having metal tracks that present a closed circuit and dielectric openings that present an open circuit. This then functions as a switch for the variable resistance control. Alternatively, one of the resistance units could be eliminated and thus only one set of contacts need be employed. In addition, as previously indicated, with suitable modifications, the control of the invention could be a rheostat or a switch.

The invention employs a resilient seal of solid, compressible material that has an extended axial length with beveled surfaces that form a taper in this lengthwise direction. This produces a pronounced slenderness for the seal. The ratio of the axial length of the seal to the average radial thickness is within the range of about 2:1 to 3:1, and this gives the seal a relatively low spring, or stress-strain rate. As a result, considerable latitude can be had in the dimensional tolerances of the parts, and the seal will be able to compress to produce reaction forces that hold the shaft assembly in a position biased fully toward the rear, in which the rotary resistance units 2 are properly spaced and stable with respect to the stationary contacts 10, 11, 12.

It will be readily apparent to those skilled in the art that a number of variations can be made without departing from the spirit and scope of the present invention, which is intended to be limited only by the claims which follow.

I claim:

1. An electrical control comprising:

(a) a housing having a base portion, side walls extending rearward of the base portion to define a hollow interior, an annular seal cavity in the body portion having a circumferential wall and an axial end wall which opens upon the hollow interior, a bushing on the base portion opposite said side walls and seal cavity, and a cover at the rear of said side walls with an internal bearing opening upon the housing interior and in alignment with said bushing;

(b) a shaft received in said bushing extending through said seal cavity, and with an end journal in said bearing, said shaft having a radial extending flange having a pressure face facing said seal cavity end wall to define the axial extent thereof;

(c) a rotary unit within said housing mounted on said shaft that is between said pressure face and said end journal;

(d) terminal members extending through said housing side walls with connection portions outside said housing and contact fingers within said housing engaging said rotary unit; and (e) an annular, resilient seal having an axial length exceeding its radial thickness and circumferentially extending beveled faces, said seal being positioned in the seal cavity and axially compressed between the pressure face of the flange of said shaft and the cavity end wall to prevent shaft end play and radially compressed between the cavity circumferential wall and the shaft to provide liquid tight seals.

2. The electrical control of claim 1 in which the cross sectional shape in the axial plane of the annular seal is the shape of a truncated diamond.

3. The electrical control of claim 1 in which the annular seal has a cross sectional configuration in which the axial length exceeds the radial thickness in the range of about 2:1 to 3:1.

* * * * *